United States Patent [19]

Larsson et al.

[11] 4,180,018

[45] Dec. 25, 1979

[54] HEATING BOILER

[75] Inventors: Bruno Larsson; Kurt Bohm; Janeric Ström; Börje Åslund, all of Norrahammar, Sweden

[73] Assignee: Parca Norrahammar AB, Sweden

[21] Appl. No.: 835,308

[22] Filed: Sep. 21, 1977

[30] Foreign Application Priority Data

Sep. 29, 1976 [SE] Sweden ..... 7610772

[51] Int. Cl.[2] ..... F22B 25/00

[52] U.S. Cl. ..... 122/225 R; 122/182 S

[58] Field of Search ..... 122/182 R, 182 S, 182 T, 122/223, 225 R, 225 F, 209 A

[56] References Cited

U.S. PATENT DOCUMENTS

| | | | |
|---|---|---|---|
| 1,085,210 | 1/1914 | Kitchen | 122/225 |
| 1,851,453 | 3/1932 | Silver | 122/225 |
| 2,173,115 | 9/1939 | Hutto | 122/182 |
| 4,022,163 | 5/1977 | Baumgartner et al. | 122/225 |

*Primary Examiner*—Kenneth W. Sprague

*Attorney, Agent, or Firm*—Holman & Stern

[57] ABSTRACT

A heating boiler with a combustion chamber between a front wall, a rear wall and a convection part in each one of the side walls, a flue system composed of parallel flues of substantially circular cross-section arranged vertically in different cross-section planes through the boiler with at least two flues in each side wall in one and the same cross sectional plane, forming upwards or downwards passages for flue gases.

8 Claims, 4 Drawing Figures

HEATING BOILER

The present invention relates to boilers, of the kind intended for forced or natural draft, and provided with a combustion chamber, enclosed by front, rear and side walls, the combustion chamber being adapted for burning solid, liquid or gaseous fuel.

Many types of boilers are known. For example a boiler of the sectional type is known comprising front, intermediate and rear sections, together forming a combustion chamber, and a flue system which leads through each section, in separate turning and connecting ducts, to a collecting flue extending along the entire length of the boiler and opening out into a chimney stack.

Compared with such a known boiler type, the present invention provides a boiler with increased heating efficiency, simpler construction and the possibility of firing different types of fuel.

According to this invention, there is provided a boiler having a combustion chamber defined by front, rear and side walls and a convection part in each one of the side walls of the boiler, a flue system composed of substantially parallel flues which lead from the combustion chamber to at least one collecting duct extending in a longitudinal direction of the boiler, characterized in that the flues are arranged in a vertical direction in different cross-sectional planes through the boiler with at least two flues in each side wall in one and the same cross-sectional plane which are arranged to form upward or downward passages for flue gases, and in that the inlets to the respective flues have a tangential direction to the wall of the flues, substantially perpendicular to the longitudinal direction of the flue.

The increased efficiency is a consequence of the siting of the flue ducts in side walls of the boiler, the wall thickness being made use of for several forward and return passages with turbulence-producing means arranged in each such passage. A simplified construction is obtained in that the boiler is provided with detachable sections, one or more of which can be substituted by openable doors through which solid fuel can be introduced into the combustion chamber. Due to this arrangement, it is possible to convert the boiler in a simple manner from liquid to solid fuel. A boiler in accordance with the invention thus meets an important need in the event of shortage of liquid fuel, in that it prevents a breakdown in heat production as a consequence of restrictions in oil imports.

Figure 1:
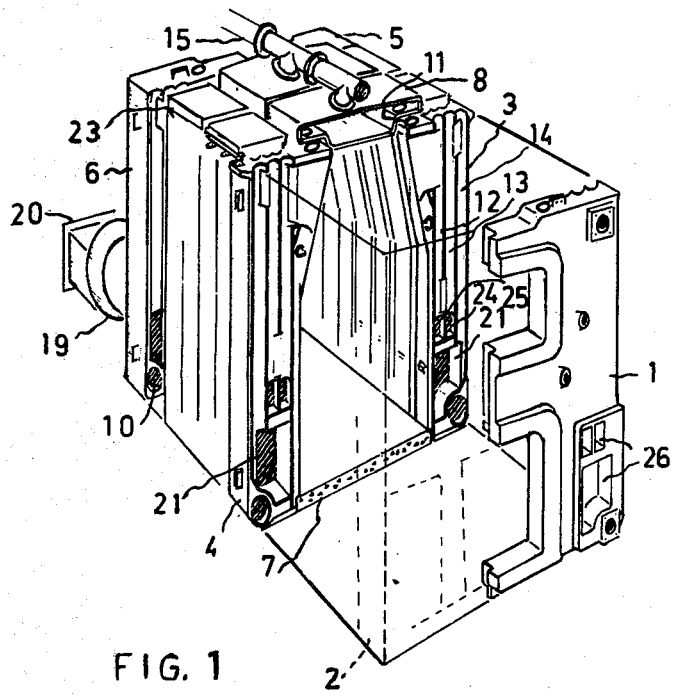
Figure 4:
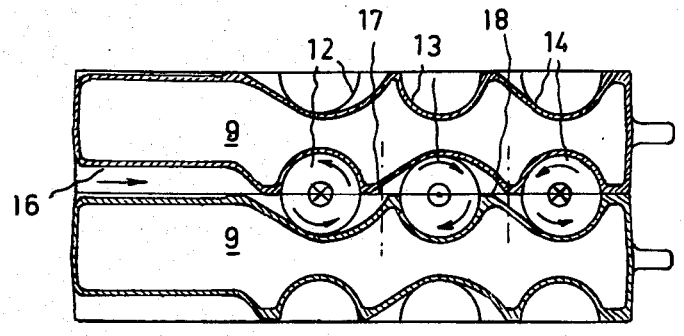
Figure 2:
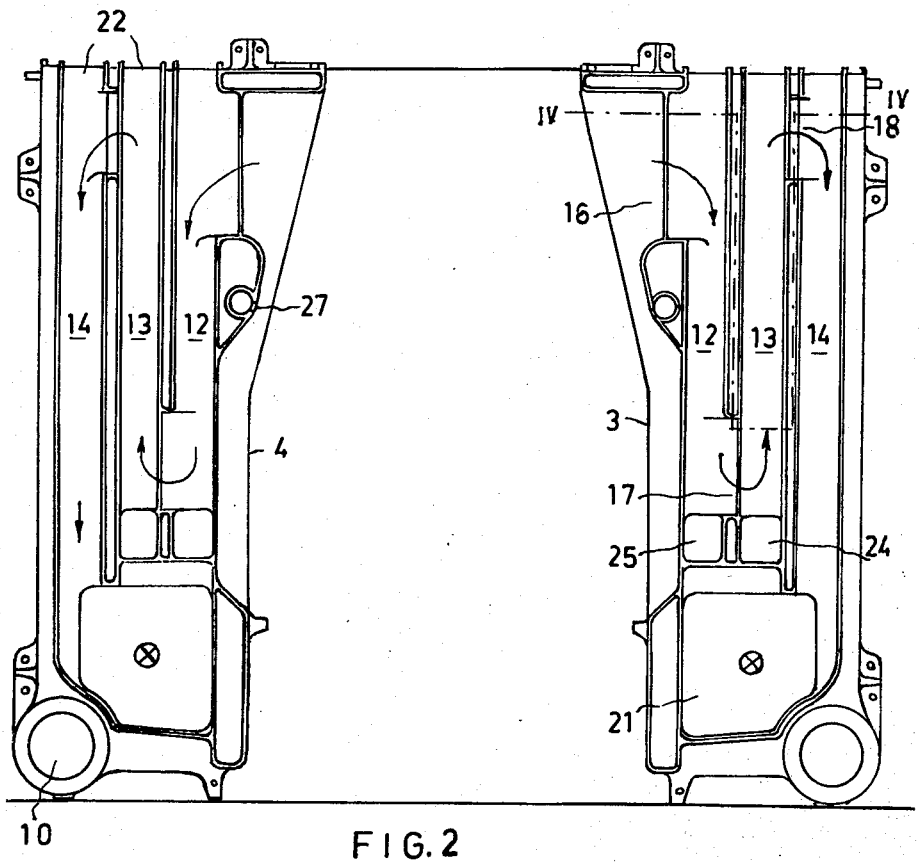
Figure 3:
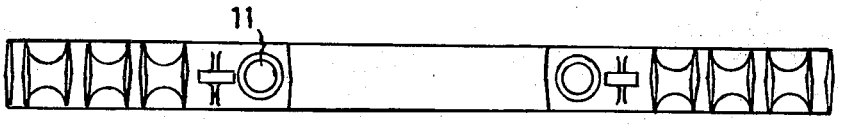

In order that the invention may be readily understood, and further features made apparent, an embodiment of a boiler in accordance with the invention is described in the following with reference to the accompanying drawing in which:

FIG. 1 is a perspective view of a partly dismantled boiler according to the invention, FIG. 2 is an intermediate section component in front elevation, FIG. 3 a plan view of the intermediate section component shown in FIG. 2, and FIG. 4 a cross-section of the boiler flues along the line IV—IV of FIG. 2.

The embodiment shown is basically a sectional boiler with a front section 1,2, intermediate sections 3, 4 and a rear section 5,6. The bottom of the boiler, as can best be seen from FIG. 1, consists of a slab 7 of refractory material, whilst the roof consists of one or more roof sections 8. The construction of the boiler shown follows a system wherein all of the sections are formed of two halves 1 and 2, 3 and 4, 5 and 6 respectively, whereby the individual components can be made of a convenient size and weight so that they can be more readily handled, e.g. during assembly of the boiler which preferably takes place on site in a boiler-room. The intermediate half-sections 3 and 4 are placed on end at each side of the bottom slab 7 and bolted together with the adjoining sections, as can be seen from FIG. 1. A water chamber 9 extends through each half-sections 3, 4 (FIG. 4) which, in the lower part, is open towards the respective adjoining intermediate half sections through circular openings 10 (FIG. 2) and, in the upper part, is open upwardly through a hole 11 (FIG. 3). The openings 10 in the lower part of a number of adjoining intermediate half sections combine in a row to form a collecting or distributing duct through the entire boiler body, which duct is connected outwardly to a return line. The water chamber communicates via the holes 11, with the hollow roof sections 8 which are tightly connected to said half sections by means of bolts and nuts.

The boiler has a convection part located in its side walls formed by the combined intermediate sections, which in pairs form flues 12, 13 and 14 (FIG. 4) extending in a transverse direction of the boiler. The flues are surrounded on all sides by a part of the heat-absorbing water chamber 9, to which water is introduced through the openings 10 in the lower part, and withdrawn through a collecting duct formed by the roof sections 8 extending along the entire boiler body and connecting to a riser line 15.

The construction of the intermediate sections can be seen from FIGS. 2 and 3. Both the section sides facing the adjoining sections are taken up by three parallel channels which together with corresponding channels in the adjoining section form the flues 12, 13, 14, as shown in cross-section in FIG. 4. The flue 12 has in its upper part an inlet 16 (FIG. 2) and in the lower part an opening passage 17 to the flue 13 which, in turn, at its upper end has a similar passage 18 to the flue 14. The inlet 16 and the passages 17, 18 have a tangential direction to the cross-section of the respective flue, as a result of which a turbulent movement is imparted to the flue gas stream on entering the duct. As discussed hereinbefore it is intended to provide the boiler, in one application, with equipment for a forced draft. This is achieved in this embodiment by means of a flue gas fan 19 located in a common outlet 20 of two flue gas collecting ducts 21 connecting the flues 14 situated on each side of the boiler. The fan produces a suction which induces the flue gases to flow at high speed from the combustion chamber out into the convection part through the tangential inlets 16, the passages 17, 18 and the flues 12, 13, 14, with the flue gas jets being directed tangentially into the cross-section of the flues. A schematic flow diagram of the turbulent path of the flue gases through the flues is indicated by arrows in FIG. 4. A similar effect is obtained if the fan of the burners is used to create a pressure in the combustion chamber. In the event of a natural draft, the principle is the same but the gas flow is slower. The turbulence is greatest at the inlet to the particular flue and diminishes along the path of the gas flow through the flue. The passages 17, 18 create extra turbulence in their respective flues, so that a high degree of turbulence is maintained in the whole of the convection part without additional turbulence inducing formers having to be installed. The convection part is provided with inspection and sweeping openings 22 which, during operation, are covered by flaps 23. The flues are accessible through the openings for sweeping. The soot from the flue 14 is collected in the flue gas collecting ducts 21 and the soot from the flues 12, 13 is collected in a pair of soot passages 24, 25 underneath the respective flue. The soot is removed from the duct 21 and the passages 24, 25, through soot doors 26 at the front and rear of the boiler.

In the embodiment shown, the boiler has a complete bottom slab 7 which forms part of the equipment when the boiler is arranged for oil firing. The equipment may be complemented by a grate, so that the boiler will be suitable for wood firing and the bottom slab may incorporate an automatic fuel feed, of the so-called mechanical stoker type, for the firing of chippings or coal. It has been mentioned hereinbefore that one or more detachable sections (e.g. a roof section) can be substituted for an openable door so that solid fuel, e.g. wood, can be introduced directly into the combustion chamber. In the case of wood-firing, the boiler may have a modified roof section which then forms an inserted frame in the roof opening and a roof door which fits tightly into the frame. Where other solid fuel is used there is also the possibility of introducing through longitudinal ducts 27 in the sections, by means of a fan, secondary air to the combustion chamber with uniform distribution over the whole combustion chamber.

The embodiment described above may be varied within the scope of the invention. Thus it is possible to alter the flues in respect of number and direction, for example, the flue gas collecting duct may be placed on the top of the boiler. In the boiler described the inlet to the convection part has been located in the area between two sections, but a construction where the inlet is situated inside the sections can also be envisaged. It is not a prerequisite, either, that the boiler sections must be cast; an alternative manufacture of the convection part is welding which gives rise to a different construction, for example, manufacture of a boiler side in one piece. The scope of the invention is defined in the following patent claims.

What we claim is:

1. A boiler having a roof portion, a front wall, a rear wall, side walls, and a collecting duct extending in the longitudinal direction of the boiler, said front, rear, and side walls defining a combustion chamber; said side walls comprising alternating water chamber portions and convection portions; each of said convection portions comprising at least two vertical cylindrical substantially parallel flues, each having an inlet and an outlet, connected serially thereby providing upward or downward passages for flue gases, the inlet of the first being open to the combustion chamber and the outlet of the last being connected to said collecting duct; said at least two vertical flues of each convection portion being arranged in one transverse cross-sectional plane of the boiler; and the inlet to each flue having a tangential direction to the wall of the flue, substantially perpendicular to the longitudinal direction of the flue.

2. The boiler in accordance with claim 1, further comprising soot passages arranged underneath respective flues in the longitudinal direction of the boiler and said roof portion comprises sweeping openings and flaps, said flaps covering said openings.

3. The boiler in accordance with claim 1, further comprising a flue gas fan connected to said collecting duct.

4. The boiler in accordance with claim 1, further comprising a duct arranged along the sides of the combustion for the introduction of secondary air.

5. The boiler in accordance with claim 1, wherein said roof portion comprises at least one water chamber which communicates with corresponding water chamber portions of the side walls.

6. The boiler in accordance with claim 5, wherein said roof portion has a central opening with a covering flap.

7. The boiler in accordance with claim 5, wherein the water flow in the water chamber portions of the side walls is arranged in the opposite direction to the flow path of the flue gases in the flues.

8. The boiler in accordance with claim 1, wherein said cross-sectional planes form the joint faces of a number of boiler sections which form the boiler body, and channel-shaped recesses are provided in the plane sides which, when the sections are assembled in pairs, form the flues.

* * * * *